US005497992A

United States Patent [19]

Ritke

[11] Patent Number: 5,497,992

[45] Date of Patent: Mar. 12, 1996

[54] GOLF CLUB AND SET HAVING SHAFT AXIS EXTENDING THROUGH IMPACT POINT

[76] Inventor: Harold A. Ritke, 1932 S. Kingsway Dr., Aurora, Ill. 60506

[21] Appl. No.: 308,221

[22] Filed: Sep. 19, 1994

[51] Int. Cl.[6] ..... A63B 53/02

[52] U.S. Cl. ..... 273/167 G; 273/80 C; 273/77 A

[58] Field of Search ..... 273/77 A, 167 R, 273/167 D, 167 G, 80.2, 80 C

[56] References Cited

U.S. PATENT DOCUMENTS

| | | | |
|---|---|---|---|
| 2,784,969 | 10/1953 | Brandon | 273/167 G |
| 2,926,913 | 3/1960 | Stecher | 273/167 G |
| 5,183,255 | 2/1993 | Antonious | 273/167 G |
| 5,199,707 | 4/1993 | Knox | 273/167 G |
| 5,312,105 | 5/1994 | Cleveland | 273/167 G |

*Primary Examiner*—William M. Pierce
*Attorney, Agent, or Firm*—Ernest Kettelson

[57] ABSTRACT

A golf club having a club shaft connected to a club head wherein the club head has a preselected "sweet spot" or preferred impact point on the surface itself of the club head face, and the shaft of the club is positioned so its longitudinal axis when extended intersects and passes through such "sweet spot" or impact point on the surface of the club head face. The club head is balanced by making the weight equal on each side of a diagonal plane through the club head coincident with the extended axis of the club shaft and normal to its face, even though the total volume of the portion of the club head on one side of such diagonal plane may be greater than the portion on the other side thereof.

10 Claims, 8 Drawing Sheets

GOLF CLUB AND SET HAVING SHAFT AXIS EXTENDING THROUGH IMPACT POINT

BACKGROUND OF THE INVENTION

This invention relates to a golf club suitable for use in playing the game of golf in accordance with the rules and regulations of the United States Golf Association. In particular, it relates to a club in which the extended longitudinal axis of the club shaft intersects the "sweet spot" or preferred impact point on the face of the club head.

Prior art of which the inventor is aware relating to positioning of the shaft of a golf club relative to its head include those described in the following United States patents.

U.S. Pat. No. 5,199,707 discloses a golf club of the iron type wherein the longitudinal axis of the club shaft intersects the interior part of the club head which constitutes the center of gravity thereof, rather than intersecting the impact point on the face of the club head. The center of gravity is defined as being equally spaced from the heel and toe of the golf club head, also equally spaced from its top edge and bottom edge, and furthermore centrally positioned between its front and its rear surface.

U.S. Pat. No. 4,725,062 discloses a wood type golf club head having a spherical body and a connecting arm extending radially outward thereof for connection of a club shaft thereto. When connected, the axis of the shaft passes through the center of the club head body, somewhat similar to the previous U.S. Pat. No. 5,199,707, rather than through the impact point on the face of the club head.

U.S. Pat. No. 3,966,210 discloses a golf club head having weights embedded in each side equidistant from the longitudinal midline of the club head and to the rear of the striking face as well as to the rear of the club shaft. The club shaft intersects the midline of the club head rearwardly from the striking surface.

U.S. Pat. No. 3,762,717 discloses a golf club in which the shaft axis intersects an interior portion of the club head rather than a point on its face. The lower end of the shaft and neck portion includes a rearwardly extending reinforcing arm bearing against the upper surface of the club head to help maintain the club head's face normal to the intended line of ball travel at the moment of impact with the ball.

U.S. Pat. No. 3,595,577 discloses a golf club in which the axis of the shaft extends through the interior of the club head behind the club face. It includes what is called an air foil contour around the shaft to help eliminate twisting of the club during the swing and at the time of impact with the ball.

U.S. Pat. No. 3,081,087 discloses a golf club having striking faces on both opposite sides of the club head so it can be used as either a right handed club or left handed club. The center of each face is coincident with the center line of the shaft, but in each case spaced apart outwardly therefrom. The center line of the shaft intersects the interior portion of the club head.

U.S. Pat. No. 2,926,913 discloses a golf club putter in which line A—A is described as extending through a point behind the ball contact point P on the face of the club head, and the extended axis of the shaft described as line B—B also passes through that point behind point P on the surface of the club head face.

U.S. Pat. No. 2,088,095 discloses a golf club having a streamlined head having a median line which is curved on the same radius as that of the intended arcuate path described by the head in striking a golf ball. The club head has an impact point on the club head face, and a center of gravity coincident with an aerodynamic center which is disposed within the interior of the club head directly behind the impact point on the face of the club head. The extended axis of the shaft passes through the aerodynamic center and center of gravity behind the impact point on the face.

U.S. Pat. No. 807,224 discloses a golf club in which the extended longitudinal axis of the shaft extends through the body of the club head between the front and rear surfaces to intersect a line parallel to the bottom edge of the club head spaced thereabove about half way to the top edge. The intersection point is toward the toe end of the club head and about midway between the top and bottom edges, and within the interior of the club head between the front and rear surfaces thereof.

SUMMARY OF THE INVENTION

Prior art clubs have the shaft positioned so that its extended axis either passes the club head to the heel side of the "sweet spot" or impact point on the surface of the club face, or to the rear thereof, or in some cases both to the rear and to the heel side. With such construction, when the club is swung and the ball hit with considerable impact, compressive skewing forces are transmitted across the distance between the impact point on the surface of the club head and the spaced apart portion of the club head through which, or adjacent to which, the extended axis of the shaft passes. Such compressive skewing forces tend to rotate or swivel the club head at the moment of impact. Even if such rotational or swivelling movement is slight, it can impart an undesirable and unintended spin on the golf ball causing it to slice or hook away from the intended target point.

Also, when the extended axis of the club shaft passes behind or to the side of the impact point on the face of the club head, the golfers "eye on the ball" to natural arm and body coordination aiming his swing at such point where the ball is sitting will always be slightly off target when the extended axis of the club being used passes behind or to the side of the impact point on the surface of the club head face.

The golf club in accordance with this invention solves those problems by first of all defining a specific locatable point on the surface itself of the club face where the center of the so-called "sweet spot" or impact point is, and then positioning the club shaft connected to the club head so the extended longitudinal axis of the club shaft intersects and passes through that center of the "sweet spot" on the surface itself of the club head face. Thus, the natural arm and body coordination directed by the brain from signals transmitted by eye contact on the ball will more naturally bring the "sweet spot" on the surface of the club face into straight-on contact with the ball. Also, when contact is made, there is no space between point of contact on the club face and the point where the axis of the club shaft extends through or adjacent to the club head as there is in prior art clubs, so there is no skewing or swivelling of the club head at the moment of impact with the ball to impart an unintended spin which causes the ball to slice or hook away from the intended target area. The flight of the ball toward an intended target area is more accurate with a club in which the extended axis of the club shaft intersects and passes through the center of the "sweet spot" or desired impact point on the surface itself of the club face.

The present invention also provides a more balanced golf club, by bisecting the club head on a diagonal plane coincident with the extended axis of the club shaft through the impact point on the surface of the club face to designate a first bisected portion from such diagonal plane to the toe end of the club head and a second bisected portion from such diagonal plane to the heel end of the club head, such diagonal plane intersecting the top and bottom edges of the club head at right angles but progressively farther from the heel end as such diagonal bisecting plane extends downwardly from the top edge to the bottom edge of the club head. The first and second bisected portions are then made to be equal in weight, even though one may be of greater total volume than the other. Thus, when such club head impacts the ball during a swing of the club at the "sweet spot" or selected and preferred impact point on the surface of the club face, the mass or weight of the club head on each opposite side of the impact point is equal and balanced which further prevents momentary skewing and swivelling of the club head at the critical instant of contact with the ball.

Further advantages of the golf club in accordance with this invention will become apparent from the more detailed description which follows and from the drawings.

DESCRIPTION OF PREFERRED EMBODIMENT

Figure 1:
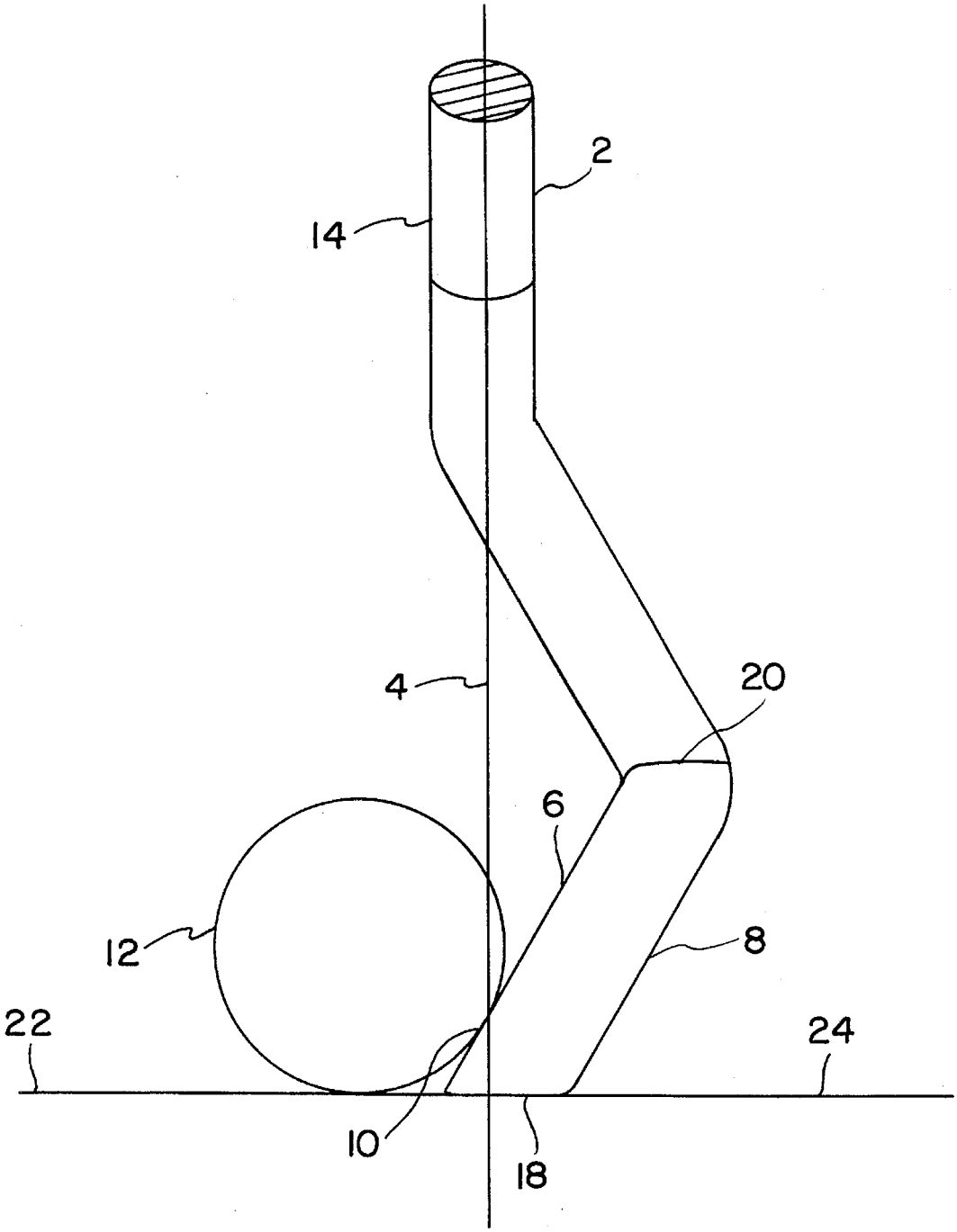
FIG. 1 is a side elevation view of a golf club in accordance with this invention, the upper part of the shaft being cut away.
Figure 2:
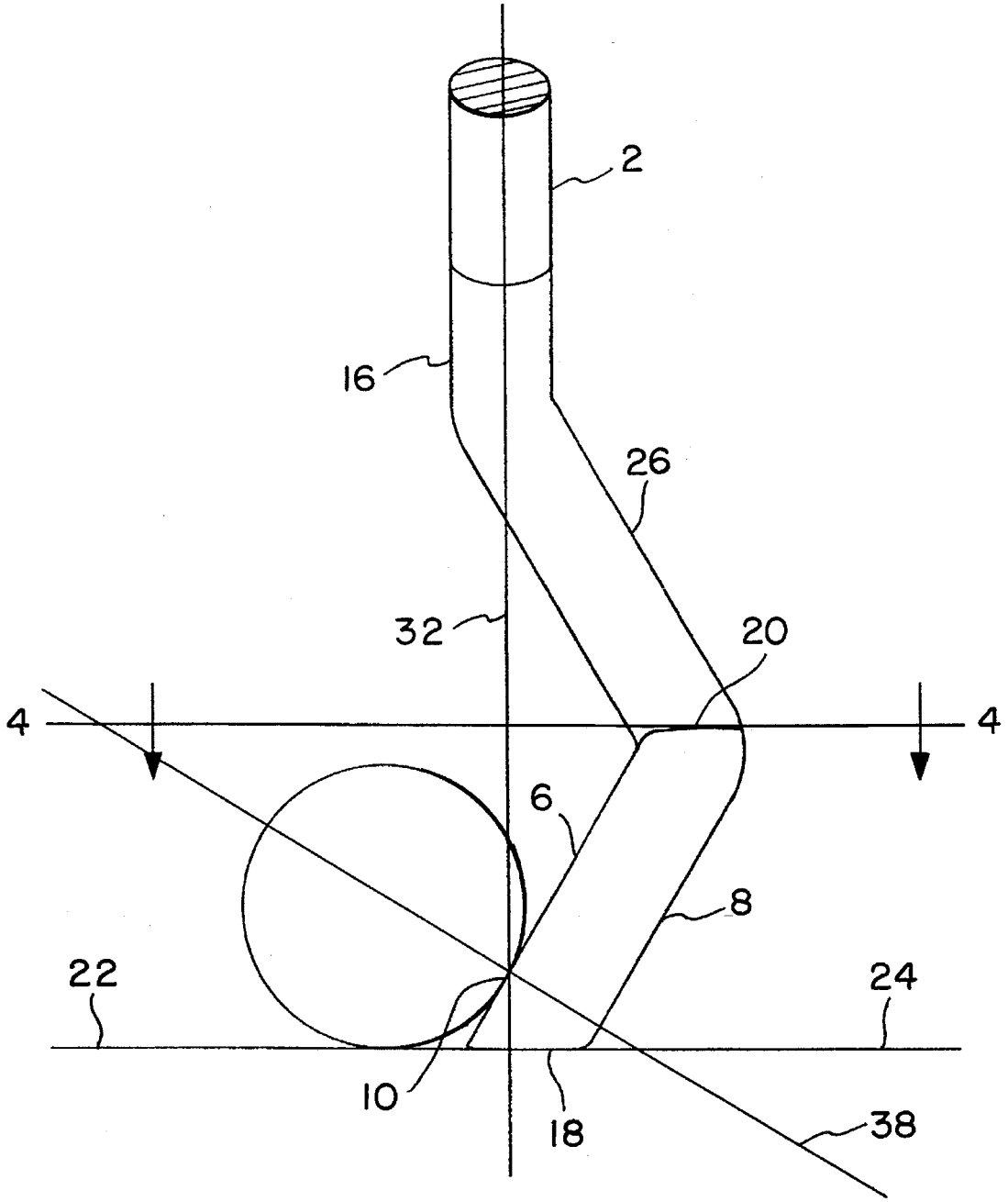
FIG. 2 is a side elevation view of an iron golf club in accordance with this invention, the upper part of the shaft being cut away, showing the extended axis of the shaft intersecting the "sweet spot" or impact point on the surface of the club head face, and showing a diagonal plane bisecting the golf ball and intersecting the plane of the club head face at a right angle.
Figure 3:
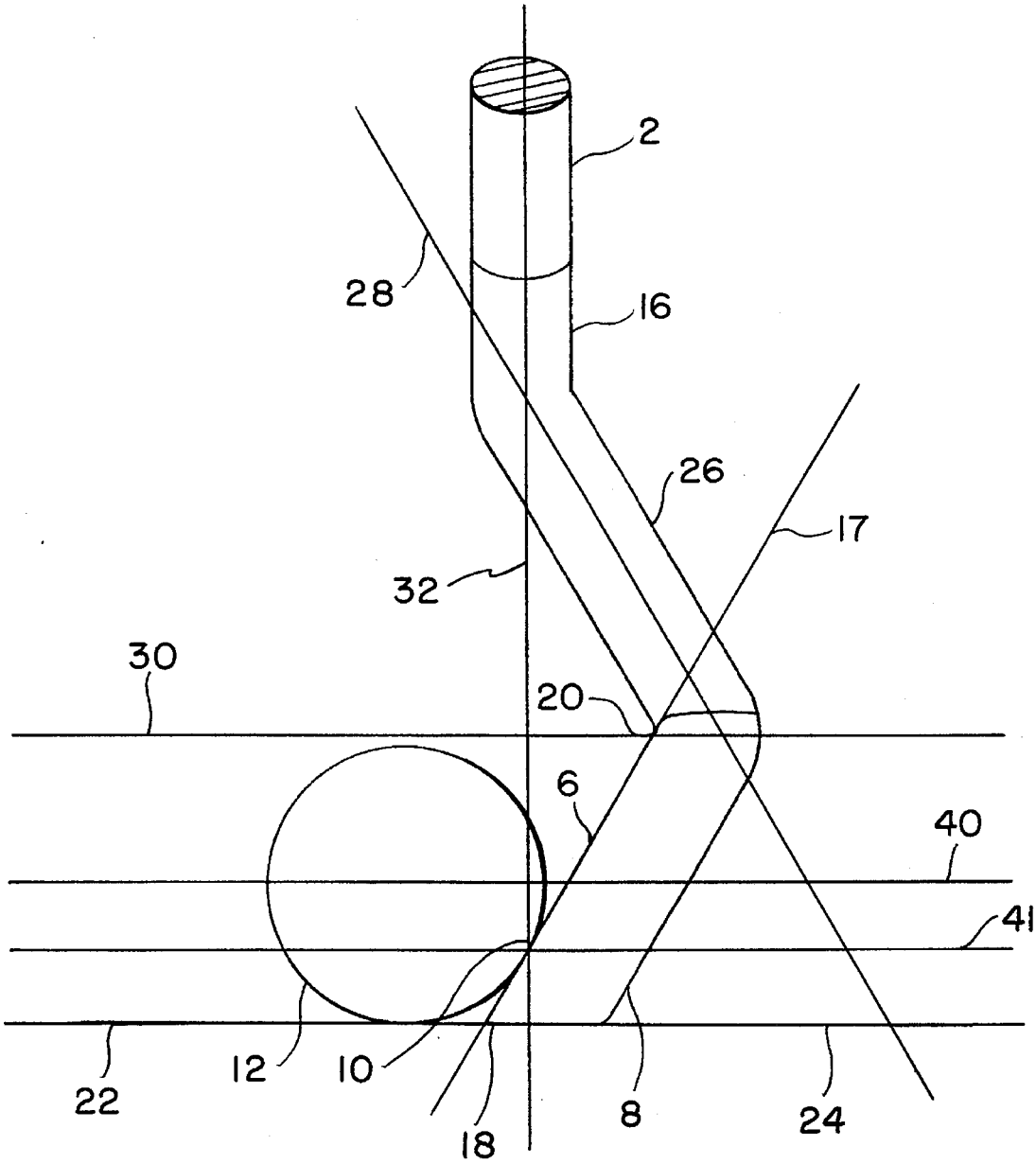
FIG. 3 is a side elevation view of the iron golf club shown in FIG. 2, showing in addition a horizontal plane through the planar face of the club head intersecting the plane of its face at an obtuse angle facing forward and an acute angle facing rearward and intersecting the axis of the club head neck at an acute angle facing forward, an obtuse angle facing rearward; also showing a horizontal plane parallel to the ground bisecting the center of the golf ball; also showing a horizontal plane parallel to the ground extending through the "sweet spot" on the club head face at predetermined height above the ground on which the golf ball is resting when the club is in the address position as shown.
Figure 4:
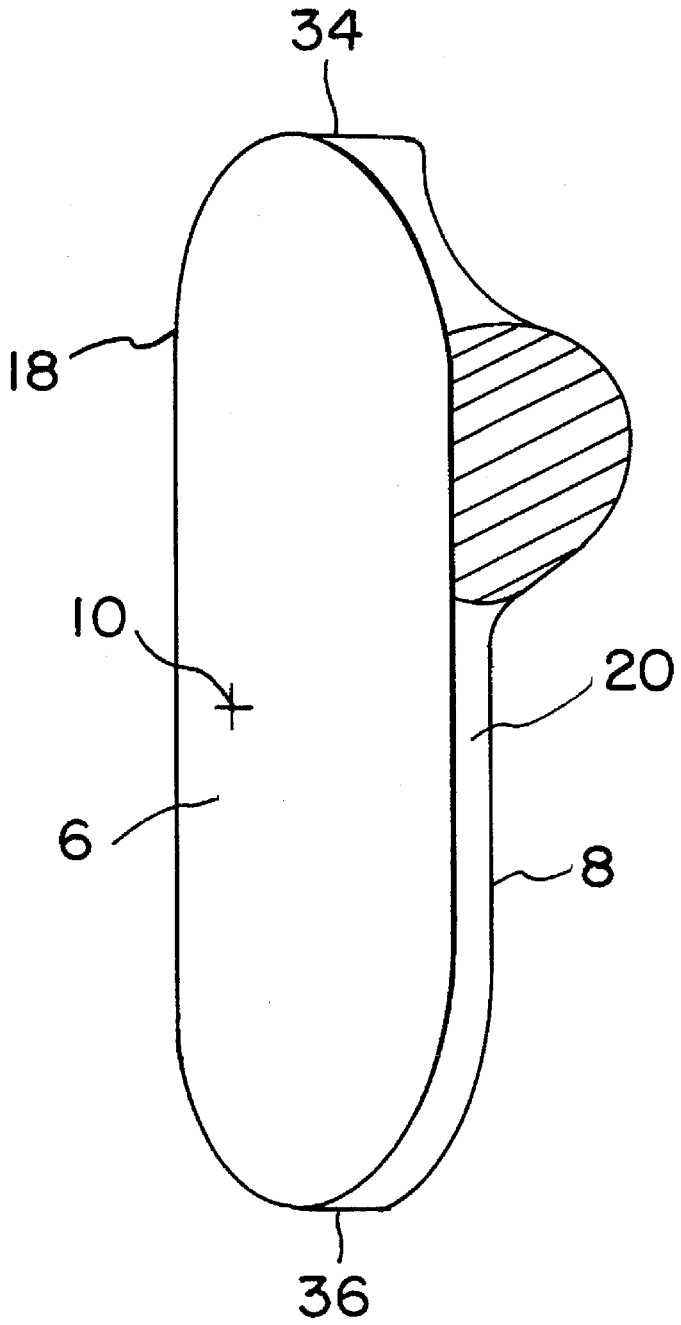
FIG. 4 is a section view taken on line 4—4 of FIG. 2.
Figure 5:
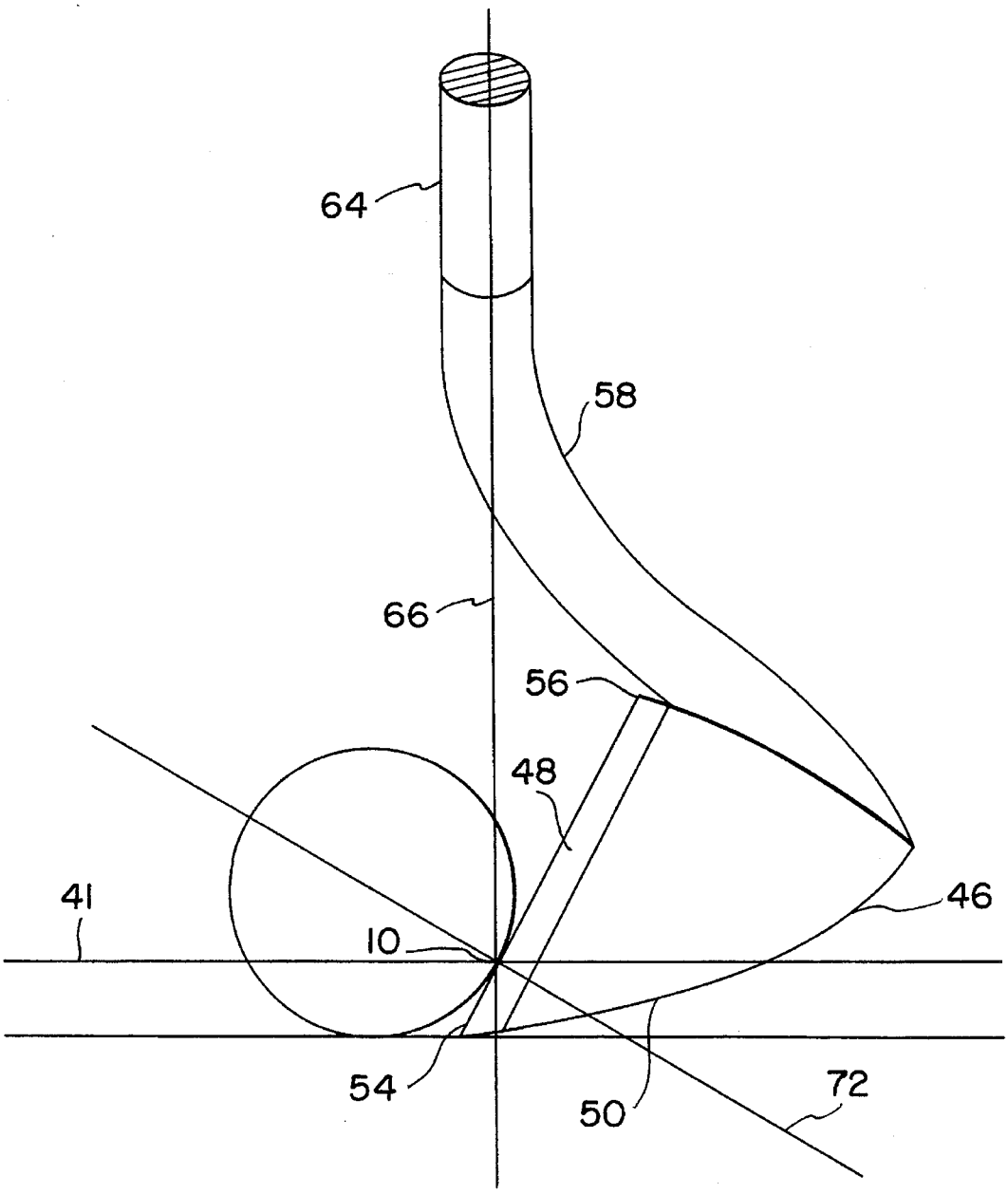
FIG. 5 is a side elevation view of a wood golf club in accordance with this invention, the upper part of the shaft being cut away, showing the extended axis of the shaft intersecting the "sweet spot" or impact point on the surface of the club head face, and showing a diagonal plane bisecting the golf ball and intersecting the plane of the club head face at a right angle; also showing a horizontal plane parallel to the ground extending through the "sweet spot" on the club head face at a predetermined height above the ground on which the golf ball is resting when the club is in the address position as shown.
Figure 6:
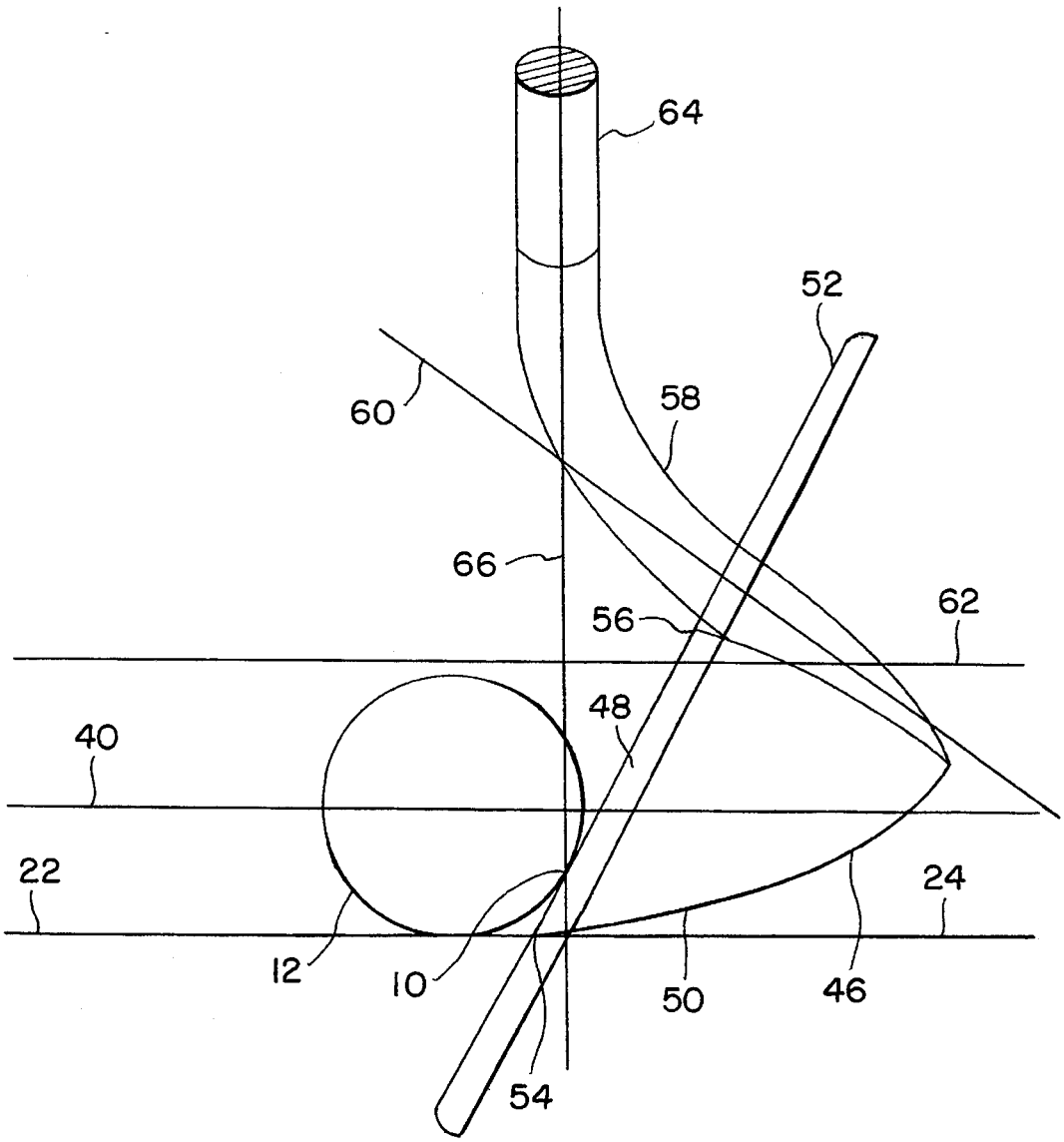
FIG. 6 is a side elevation view of the wood golf club shown in FIG. 5, showing in addition a horizontal plane through the convex face of the wood club head and intersecting its convex-concave plane at an obtuse angle facing forward and an acute angle facing rearward and intersecting the axis of the club head neck at an acute angle facing forward, an obtuse angle facing rearward; also showing a horizontal plane bisecting the center of the golf ball.
Figure 7:
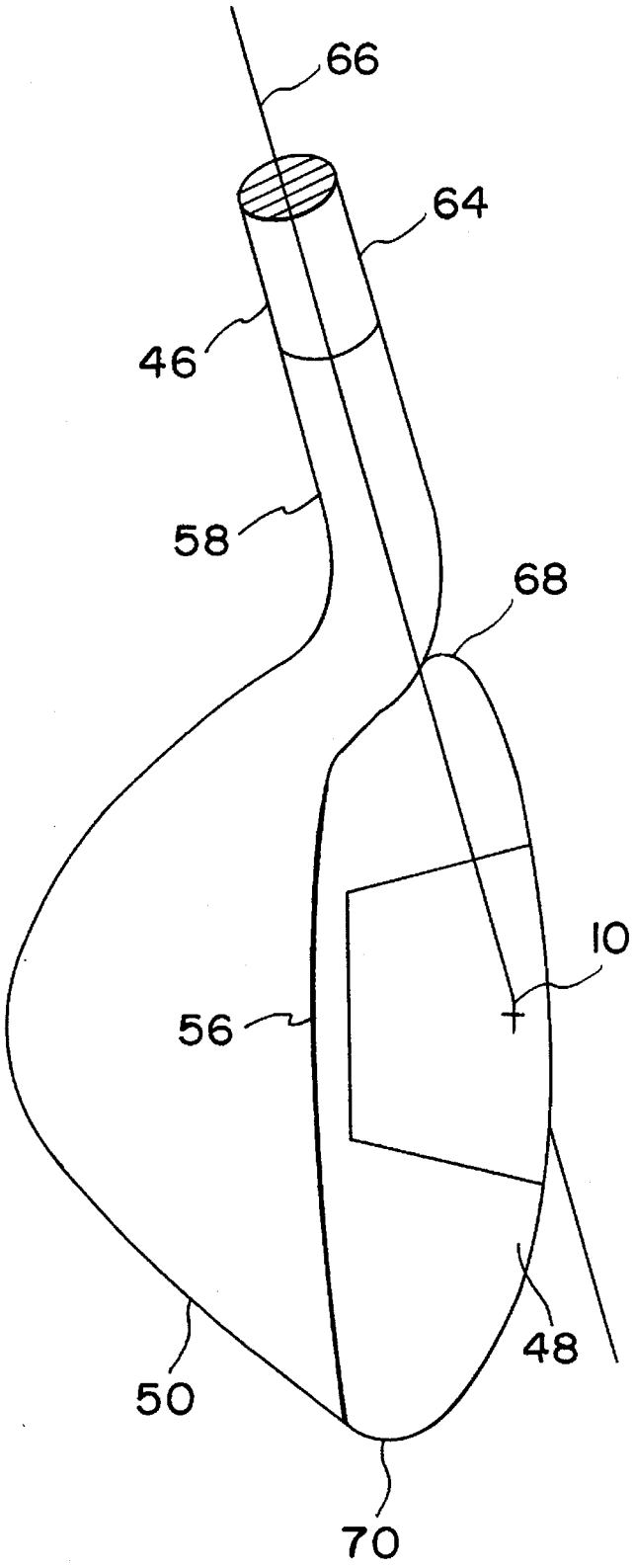
FIG. 7 is a plan view of the wood club shown in FIG. 5, showing the "sweet spot" in relation to the heel and toe of the club head and showing the extended axis of the shaft intersecting the "sweet spot" on the surface of the club head face.
Figure 8:
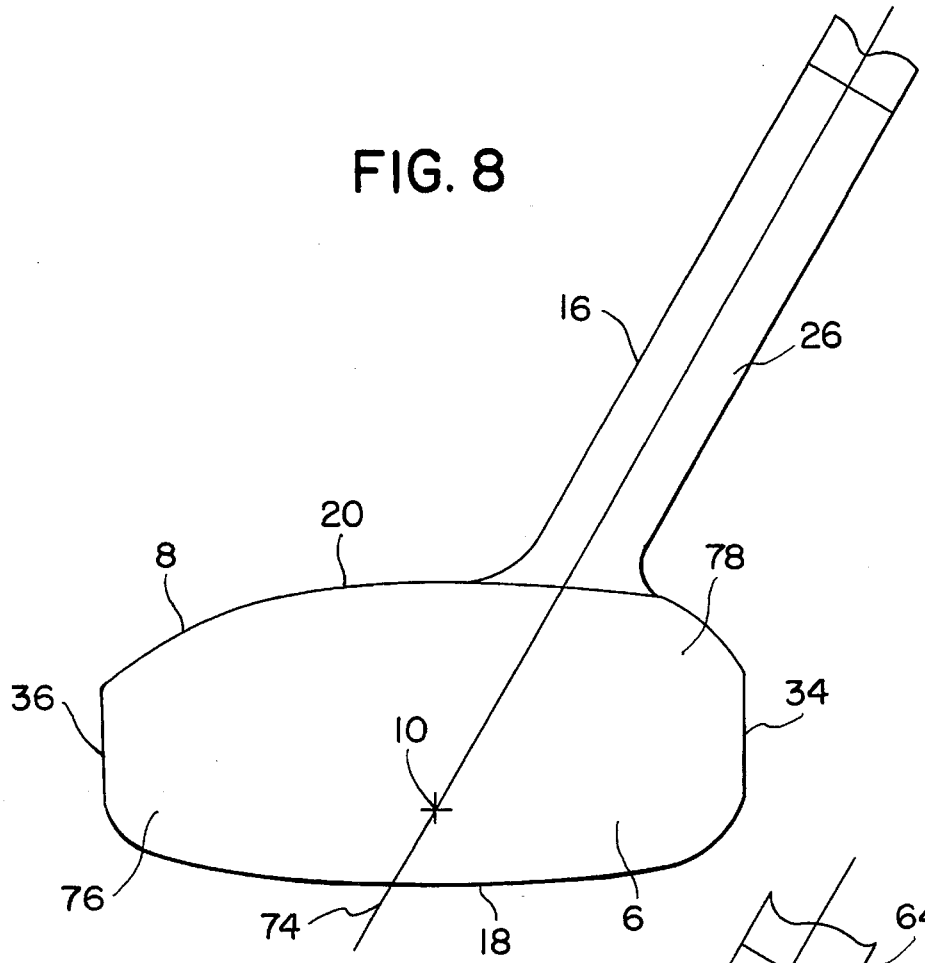
FIG. 8 is a front elevation view of the iron club shown in FIG. 2, showing the diagonal plane through the iron club head on a line coincident with the extended axis of the club shaft and normal to the face of the club head, bisecting the club head into two laterally extending portions on each side of the "sweet spot" which are made to be equal in weight even though one is larger than the other in volume.
Figure 9:
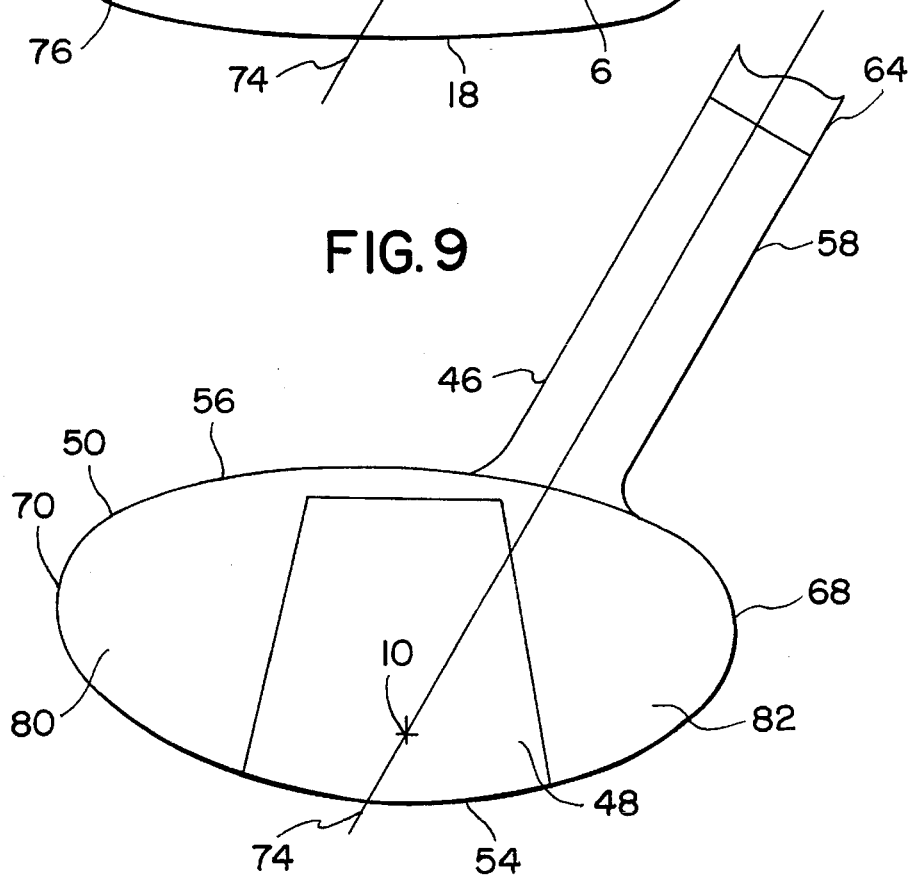
FIG. 9 is a front elevation view of the wood club shown in FIG. 7, showing the diagonal plane through the wood club head on a line coincident with the extended axis of the club shaft and normal to the face of the club head, bisecting the club head into two laterally extending portions on each side of the "sweet spot" which are made to be equal in weight even though one is larger than the other in volume.

A golf club in accordance with the present invention includes a club shaft 2 whose longitudinal axis 4 intersects the face 6 of the club head 8 at the precise point 10 where it meets the golf ball 12 if the club 14 is swung correctly. Such precise point of impact 10 is referred to as the "sweet spot."

The invention may be embodied in both types of golf clubs, irons and woods.

In an iron club 16, when in the address position, the face 6 of the club head 8 extends in a diagonal plane 17 from its bottom edge 18 to its top edge 20 which intersects the horizontal surface 22 of the ground 24 at an acute angle facing rearwardly from the ball 12 and an obtuse angle facing forwardly. The neck 26 of the iron club 16 extends upwardly from the top edge 20 of the club head 8 at a diagonal whereby its longitudinal axis 28 forms an acute angle facing forwardly and an obtuse angle facing rearwardly relative to a horizontal intersecting plane 30 through the planar face 6 of the club head 8 parallel to the surface 22 of the ground 24 when the club is in the address position.

The club shaft 2 of iron club 16 is positioned whereby its longitudinal axis 32 when extended intersects the point of impact 10 on the club head face 6 and whereby it also intersects the longitudinal axis 28 of the club neck 26. The club neck 26 is joined to the club shaft 2 at the intersection point of the longitudinal axis 28 of the club neck 26 with the longitudinal axis 32 of the club shaft 2.

In the iron club 16, the impact point 10 on the face 6 of the club head 8 is located midway between the heel 34 and toe 36, and upward from the bottom edge 18 at the point where the diagonal plane 17 of the club head face 6 is substantially normal to a plane 38 which bisects the semi-spherical halves or equator of the golf ball 12 when the club face 6 is in contact with the ball 12. Such contact must be below a horizontal plane 40 through the equator of the ball 12 for the golf ball to rise when hit. The impact point 10 on the club face 6 will therefore be upward from the bottom edge 18 a vertical distance that is less than half the diameter of the golf ball 12 when the plane 17 of the club head face 6 is in its address position adjacent the golf ball 12.

The diameter of a regulation golf ball is substantially about one and three quarters inches, so one-half of that is substantially about seven-eighths of an inch.

Thus for golf clubs in accordance with this invention, the "sweet spot" or impact point 10 is on the club face 6 midway between the heel 34 and toe 36 and at the intersection therewith of a horizontal plane 41 less than seven-eighths of an inch upwardly from the bottom edge 18 of the club head 8 when in its address position on the ground adjacent the golf ball 12.

The closer diagonal plane 17 in which the club face 6 lies is to the vertical when the iron club 16 is in its address position, meaning its acute angle facing rearwardly is relatively greater and its obtuse angle facing forwardly is relatively smaller, the greater distance upwardly and inwardly from the bottom edge 18 of the club face 6 will the impact point 10 or "sweet spot" be.

The "sweet spot" or impact point 10 of a No. Two Iron will therefore be farther from the bottom edge 18 of the club head face 6 than that of a No. Three Iron, the "sweet spot" or impact point 10 of a No. Three Iron farther from the said bottom edge 18 than that of a No. Four Iron, and so on through all of the iron clubs of a golf club set in accordance with this invention, such "sweet spot" or impact point 10 being in each case midway between the heel 34 and toe 36 of the club head 8.

The longitudinal axis 32 of the club shaft of iron club 16 which when extended intersects the "sweet spot" or impact point 10 on the club face 6 forms the most acute angle or lowest number of degrees with the plane 17 of the club face 6 in a No. Two Iron in accordance with this invention, a next less acute angle in a No. Three Iron, a next less acute angle in a No. Four Iron, and so on through all of the iron clubs of a set of clubs in accordance with this invention. The longitudinal axis 34 of the club shaft also intersects the longitudinal axis 28 of the neck 26 of each one of the respective iron clubs in the set. Such construction puts the "sweet spot" or impact point 10 directly in the plane of the travel path through which the longitudinal axis of the club shaft swings as the impact point 10 comes into hitting contact with the ball 12.

In other words, the impact point 10 on the club face 6 is not offset as in prior art clubs from the longitudinal axis of the shaft. As a result of providing the impact point 10 directly in the same plane of travel through which the longitudinal axis of the club shaft swings, there are no swivel forces or torque tending to rotate the club shaft and club head at the moment of impact.

A golfer thus has better control of the direction the ball is hit with clubs made in accordance with this invention. Also when the "sweet spot" or impact point 10 is directly in the plane of travel of the club swing and not offset therefrom, a golfer can more consistently hit the golf ball with the "sweet spot" or impact point 10 with each swing than when the "sweet spot" is offset as in prior art clubs.

In a wood club 46, the face 48 of the club head 50 is slightly convex and extends diagonally in a slightly convex-concave plane 52 from its bottom edge 54 to its top edge 56 which intersects the horizontal surface 22 of the ground 24 at an acute angle facing rearwardly from the ball 12 and an obtuse angle facing forwardly. The neck 58 of the wood club 46 extends upwardly from the top edge 56 of the club head 50 at a diagonal whereby its longitudinal axis 60 forms an acute angle facing forwardly and an obtuse angle facing rearwardly relative to a horizontal intersecting plane 62 through the convex face 48 of the club head 50 parallel to the surface 22 of the ground 24 when the club is in the address position.

The shaft 64 of the wood club 46 is positioned whereby its longitudinal axis 66 when extended intersects the point of impact 10 on the face 48 of the wood club head 50 and also intersects the longitudinal axis 60 of the neck 58 of the wood club 46. The neck 58 of the wood club 46 is joined to the shaft 64 thereof at the intersection point of the longitudinal axis 60 of the neck 58 with the longitudinal axis 66 of the shaft 64 of the wood club 46.

In the wood club 46, the impact point 10 on the convex face 48 of the club head 50 is located midway between the heel 68 and toe 70, and upward from the bottom edge 54 at the point where the diagonally extending plane 52 of the club head face 48 is substantially normal to a plane 72 which bisects the semi-spherical halves or equator of the golf ball 12 when the club face 48 is in contact with the ball 12. As in the case of the iron clubs, such contact must be below the horizontal plane 40 through the equator of the ball 12 for the golf ball to rise when hit. The impact point 10 on the club face 48 of the wood clubs 46 will therefore also be upward from the bottom edge 54 thereof a vertical distance that is less than half the diameter of the golf ball 12 when the plane 52 of the club head face 48 is in its address position adjacent the golf ball 12.

Since the diameter of a regulation golf ball is substantially about one and three quarters inches, one-half of that is substantially about seven-eighths of an inch.

Thus for wood golf clubs in accordance with this invention as well as for iron clubs, the "sweet spot" or impact point 10 is on the club face 48 of the wood clubs 46 midway between their heel 68 and toe 70 and at the intersection therewith of a horizontal plane 41 less than seven-eighths of an inch upwardly from the bottom edge 54 of the head 50 of the wood club 46 when in its address position on the ground adjacent the golf ball 12.

The closer the diagonal plane 52 of the face 48 of the wood clubs 46 is to the vertical when the wood club 46 is in the address position, meaning its acute angle facing rearwardly is relatively greater and its obtuse angle facing forwardly is relatively smaller, the greater distance upwardly and inwardly of the club head face 48 will the impact point 10 or "sweet spot" be.

The "sweet spot" or impact point 10 of a No. 1 Wood will therefore be farther from the bottom edge 54 of its face 48 than that of a No. 2 Wood, the "sweet spot" or impact point 10 of a No. 2 Wood farther from the said bottom edge 54 than that of No. 3 Wood, the "sweet spot" or impact point 10 of a No. 3 Wood farther from the said bottom edge than that of a No. 4 Wood.

The longitudinal axis 66 of the shaft 64 of the wood clubs, which when extended intersects the "sweet spot" or impact point 10 on the club face 48 forms the most acute angle or lowest number of degrees with the plane 52 of the club face 48 in a No. 1 Wood in accordance with this invention, a next less acute angle in a No. 2 Wood, a next less acute angle in a No. 3 Wood and a next less acute angle in a No. 4 Wood. The longitudinal axis 66 of the club shaft 64 also intersects with the longitudinal axis 60 of the neck 58 of wood clubs 46. Such construction puts the "sweet spot" or impact point 10 directly in the plane of the travel path through which the longitudinal axis of the club shaft swings as the impact point 10 comes into hitting contact with the ball 12.

As stated above for the iron clubs, the same for the woods, namely that the impact point 10 on the club face 48 of the wood clubs 46 is not offset as in prior art clubs from the longitudinal axis of the shaft. As a result of providing the impact point 10 directly in the plane of the path of travel through which the longitudinal axis of the club shaft swings, there are no swivel forces or torque tending to rotate the shaft 64 of the wood clubs 46 or the club head 50 thereof at the moment of impact.

Furthermore, a golfer can hit the ball with the "sweet spot" of the club head more consistently when it is directly in the plane of travel of club swing and not offset therefrom as in prior art clubs.

In accordance with this invention the iron club head 8 and the wood club head 50 are balanced, whereby the mass or weight thereof is equal on either side of a diagonal plane 74 bisecting the iron club head 8 and wood club head 50 on a line coincident with the extended longitudinal axis 32 of the club shaft 2 in the case of iron clubs and coincident with the extended longitudinal axis 66 of the club shaft 64 in the case of wood clubs, and in which the diagonal plane 74 intersects the plane of the club head face at a right angle.

In the case of the iron clubs, the diagonal plane 74 intersects the plane 17 of club head 8 at a right angle and thereby also intersects the bottom edge 18 and top edge 20 of the club head 8 at a right angle though at progressively greater distances from the heel 34 of club head 8 as the diagonal plane 74 extends therethrough from the top edge 20 to the bottom edge 18.

In the case of the wood clubs, the diagonal plane 74 intersects the plane 52 of club head 50 at a right angle and thereby also intersects the bottom edge 54 and top edge 56 of the club head 50 at a right angle though at progressively greater distances from the heel 68 of club head 50 as the diagonal plane 74 extends therethrough from the top edge 56 to the bottom edge 54.

Such bisection of club head 8 of the irons by diagonal plane 74 defines a first bisected portion 76 extending from the intersection of diagonal plane 74 to the toe 36 and a second bisected section 78 extending from the intersection of diagonal plane 74 to the heel 34. Both bisected portions 76 and 78 of the iron club heads 8 are of equal weight.

Bisection of club head 50 of the woods by diagonal plane 74 defines a first bisected portion 80 extending from the intersection of diagonal plane 74 to the toe 70 and a second bisected section 82 extending from the intersection of diagonal plane 74 to the heel 68. Both bisected portions 80 and 82 of the woods' club heads 50 are of equal weight.

Each portion may be made equal in weight though different size in volume by a number of methods. One method is to actually cut a sample club head of the material normally used into two separates portions along the diagonal plane 74, then weigh each portion to determine how much more the larger volume portion weighs. Then select a ballast made of a heavier material for inserting into a cavity that will be formed in the smaller volume portion of sufficient additional weight that when secured in the cavity of the smaller volume portion its total weight with the ballast will then equal that of the larger volume portion. When the size and weight of such ballast is known by this method of actually weighing the two separated portions, cavities of such size can then be formed in the smaller volume portion and ballast members of such predetermined size and weight can then be secured in the smaller volume portion of the club head.

I claim:

1. A golf club comprising a club shaft, a neck member having a first end and a second end, said club shaft having an adjacent end adjacent to said first end of said neck member, said first end of said neck member being connected to the said adjacent end of said club shaft, a club head having a bottom edge, a top edge, a toe end and an opposite heel end, said second end of said neck member being connected to said club head, said neck member extending upward beyond said top edge of said club head, said neck member having an elongated portion, said club head having a substantially planar club face lying in a club face plane for impact with a golf ball, said elongated portion of said neck member having a longitudinal axis extending at a diagonal forwardly from and at an angle to said club face plane, said club face having a preselected preferred impact point thereon which is upward from said bottom edge a vertical distance that is less than half the diameter of a said golf ball when said club face is in an address position adjacent a said golf ball for contact therewith, said club shaft having a longitudinal axis, said longitudinal axis of said club shaft when extended intersects the said longitudinal axis of said elongated portion of said neck member when extended and also intersects said preselected preferred impact point on said club face, wherein said preselected preferred impact point is at a point on said face of said club head substantially midway between said toe end and said heel end thereof.

2. A golf club as set forth in claim 1, wherein said longitudinal axis of said club shaft when extended forms an acute angle with said club face plane at said preselected preferred impact point.

3. A golf club comprising a club shaft, a neck member having a first end and a second end, said club shaft having an adjacent end adjacent to said first end of said neck member, said first end of said neck member being connected to the said adjacent end of said club shaft, a club head having a bottom edge, a top edge, a toe end and an opposite heel end, said second end of said neck member being connected to said club head, said neck member extending upward beyond said top edge of said club head, said neck member having an elongated portion, said club head having a convex club face lying in a convex-concave club face plane for impact with a golf ball, said elongated portion of said neck member having a longitudinal axis extending at a diagonal forwardly from and at an angle to said club face plane, said club face having a preselected preferred impact point thereon which is upward from said bottom edge a vertical distance that is less than half the diameter of a said golf ball when said club face is in an address position adjacent a said golf ball for contact therewith, said club shaft having a longitudinal axis, said longitudinal axis of said club shaft when extended intersects the said longitudinal axis of said elongated portion of said neck member when extended and also intersects said preselected preferred impact point on said club face, wherein said preselected preferred impact point is at a point on said face of said club head substantially midway between said toe end and said heel end thereof.

4. A golf club as set forth in claim 3, wherein said longitudinal axis of said club shaft when extended forms an acute angle with said club face plane at said preselected preferred impact point.

5. A golf club comprising a club shaft, a club head having a bottom edge, a top edge, a toe end and an opposite heel end, said club shaft being connected to said club head, said club head having a club face, said club face having a preselected preferred impact point thereon which is upward from said bottom edge a vertical distance that is less than half the diameter of a said golf ball when said club face is in an address position adjacent a said golf ball for contact therewith, said club shaft having a longitudinal axis, said longitudinal axis of said club shaft when extended intersects said preselected preferred impact point on said club face, wherein said preselected preferred impact point is at a point on said face of said club head substantially midway between said toe end and said heel end thereof.

6. A golf club as set forth in claim 5, wherein said club head is bisected by a diagonal plane into a first portion extending to said toe end and a second portion extending to said heel end, said diagonal plane extending coincident with said longitudinal axis of said club shaft when extended and intersecting said top edge and said bottom edge of said club head at right angles progressively further from said heel end of said club head as said diagonal plane extends downwardly therethrough from said top edge of said club head to said bottom edge thereof, the weight of said first portion being substantially equal to the weight of said second portion.

7. A plurality of golf clubs in a set, each comprising a club shaft, a neck member having a first end and a second end, said club shaft having an adjacent end adjacent to said first end of said neck member, said first end of said neck member being connected to the said adjacent end of said club shaft, a club head having a bottom edge, a top edge, a toe end and an opposite heel end, said second end of said neck member being connected to said club head, said neck member extending upward beyond said top edge of said club head, said neck member having an elongated portion, said club head having a substantially planar club face lying in a club face plane for impact with a golf ball, said elongated portion of said neck member having a longitudinal axis extending at a diagonal forwardly from and at an angle to said club face plane, said club face having a preselected preferred impact point thereon which is upward from said bottom edge a vertical distance that is less than half the diameter of a said golf ball when said club face is in an address position adjacent a said golf ball for contact therewith, said club shaft having a longitudinal axis, said longitudinal axis of said club shaft when extended intersects the said longitudinal axis of said elongated portion of said neck member when extended and also intersects said preselected preferred impact point on said club face, wherein said preselected preferred impact point is at a point on said face of said club head substantially midway between said toe end and said heel end thereof, wherein said longitudinal axis of said club shaft when extended forms an acute angle with said club face plane at said preselected preferred impact point, wherein one of said golf clubs is a No. 2 Iron, including a second golf club, said second golf club being a No. 3 Iron, said acute angle formed by said extended longitudinal axis of said club shaft of said No. 2 Iron with said club face plane thereof at said preselected preferred impact point thereon being more acute meaning a lesser number of degrees than said acute angle formed by said extended longitudinal axis of said club shaft of said No. 3 Iron with said club face plane thereof at said preselected preferred impact point thereon.

8. A plurality of golf clubs in a set, each comprising a club shaft, a neck member having a first end and a second end, said club shaft having an adjacent end adjacent to said first end of said neck member, said first end of said neck member being connected to the said adjacent end of said club shaft, a club head having a bottom edge, a top edge, a toe end and an opposite heel end, said second end of said neck member being connected to said club head, said neck member extending upward beyond said top edge of said club head, said neck member having an elongated portion, said club head having a substantially planar club face lying in a club face plane for impact with a golf ball, said elongated portion of said neck member having a longitudinal axis extending at a diagonal forwardly from and at an angle to said club face plane, said club face having a preselected preferred impact point thereon which is upward from said bottom edge a vertical distance that is less than half the diameter of a said golf ball when said club face is in an address position adjacent a said golf ball for contact therewith, said club shaft having a longitudinal axis, said longitudinal axis of said club shaft when extended intersects the said longitudinal axis of said elongated portion of said neck member when extended and also intersects said preselected preferred impact point on said club face, wherein said preselected preferred impact point is at a point on said face of said club head substantially midway between said toe end and said heel end thereof, wherein said preferred impact point is at a point on said face of said club head below a plane which is substantially seven-eighths of an inch above said bottom edge of said club head and substantially parallel thereto, wherein one of said golf clubs is a No. 2 Iron, including a second golf club, said second golf club being a No. 3 Iron, said preselected preferred impact point on said face of said club head of said No. 2 Iron being closer to said plane and farther upwardly and inwardly on said club face than said preselected preferred impact point is on said face of said club head of said No. 3 Iron.

9. A plurality of golf clubs in a set, each comprising a club shaft, a neck member having a first end and a second end, said club shaft having an adjacent end adjacent to said first end of said neck member, said first end of said neck member being connected to the said adjacent end of said club shaft, a club head having a bottom edge, a top edge, a toe end and an opposite heel end, said second end of said neck member being connected to said club head, said neck member extending upward beyond said top edge of said club head, said neck member having an elongated portion, said club head having a substantially planar club face lying in a club face plane for impact with a golf ball, said elongated portion of said neck member having a longitudinal axis extending at a diagonal forwardly from and at an angle to said club face plane, said club face having a preselected preferred impact point thereon which is upward from said bottom edge a vertical distance that is less than half the diameter of a said golf ball when said club face is in an address position adjacent a said golf ball for contact therewith, said club shaft having a longitudinal axis, said longitudinal axis of said club shaft when extended intersects the said longitudinal axis of said elongated portion of said neck member when extended and also intersects said preselected preferred impact point on said club face, wherein said preselected preferred impact point is at a point on said face of said club head substantially midway between said toe end and said heel end thereof, wherein said longitudinal axis of said club shaft when extended forms an acute angle with said club face plane at said preselected preferred impact point, wherein one of said golf clubs is a No. 1 Wood, including a second golf club, said second golf club being a No. 2 Wood, said acute angle formed by said extended longitudinal axis of said club shaft of said No. 1 Wood with said club face plane thereof at said preselected preferred impact point thereon being more acute meaning a lesser number of degrees than said acute angle formed by said extended longitudinal axis of said club shaft of said No. 2 Wood with said club face plane thereof at said preselected preferred impact point thereon.

10. A plurality of golf clubs in a set, each comprising a club shaft, a neck member having a first end and a second end, said club shaft having an adjacent end adjacent to said first end of said neck member, said first end of said neck member being connected to the said adjacent end of said club shaft, a club head having a bottom edge, a top edge, a toe end and an opposite heel end, said second end of said neck member being connected to said club head, said neck member extending upward beyond said top edge of said club head, said neck member having an elongated portion, said club head having a substantially planar club face lying in a club face plane for impact with a golf ball, said elongated portion of said neck member having a longitudinal axis extending at a diagonal forwardly from and at an angle to said club face plane, said club face having a preselected preferred impact point thereon which is upward from said bottom edge a vertical distance that is less than half the diameter of a said golf ball when said club face is in an address position adjacent a said golf ball for contact therewith, said club shaft having a longitudinal axis, said longitudinal axis of said club shaft when extended intersects the said longitudinal axis of said elongated portion of said neck member when extended and also intersects said preselected preferred impact point on said club face, wherein said preselected preferred impact point is at a point on said face of said club head substantially midway between said toe end and said heel end thereof, wherein said preferred impact point is at a point on said face of said club head below a plane which is substantially seven-eighths of an inch above said bottom edge of said club head and substantially parallel thereto, wherein one of said golf clubs is a No. 1 Wood, including a second golf club, said second golf club being a No. 2 Wood, said preselected preferred impact point on said face of said club head of said No. 1 Wood being closer to said plane and farther upwardly and inwardly on said club face than said preselected preferred impact point is on said face of said club head of said No. 2 Wood.

* * * * *